United States Patent [19]

Fischer et al.

[11] Patent Number: 4,660,778

[45] Date of Patent: Apr. 28, 1987

[54] IMPELLER FOR COMMINUTING EQUIPMENT

[75] Inventors: Robert R. Fischer, Michigan City; Joe R. Urschel, Valparaiso, both of Ind.

[73] Assignee: Urschel Laboratories, Inc., Valparaiso, Ind.

[21] Appl. No.: 885,751

[22] Filed: Jul. 22, 1986

Related U.S. Application Data

[60] Continuation of Ser. No. 733,536, May 13, 1985, abandoned, which is a division of Ser. No. 546,182, Oct. 27, 1983, Pat. No. 4,610,397.

[51] Int. Cl.[4] ..... B02C 18/16

[52] U.S. Cl. ..... 241/292.1; 241/296

[58] Field of Search ..... 241/84.4, 95, 199.12, 241/242, 257 R, 260, 292.1, 296, 298, 86, 257 G, 46 A, 46 B, 188 R, 299; 366/302, 305, 307, 317; 416/203

[56] References Cited

U.S. PATENT DOCUMENTS

| | | | |
|---|---|---|---|
| 360,833 | 4/1887 | Vogelsang | 416/203 |
| 1,010,487 | 12/1911 | Flindt | 416/203 |
| 2,577,152 | 12/1951 | Powers | 241/257 G |
| 2,697,589 | 12/1954 | Davey | 416/203 |
| 3,236,462 | 2/1966 | Stout | 241/257 G |
| 4,013,273 | 3/1977 | Danyliw | 416/203 X |

FOREIGN PATENT DOCUMENTS

| | | | |
|---|---|---|---|
| 1017261 | 10/1957 | Fed. Rep. of Germany | 416/203 |
| 1061266 | 4/1954 | France | 416/203 |
| 525140 | 4/1955 | Italy | 416/203 |
| 2046360 | 11/1980 | United Kingdom | 416/203 |

*Primary Examiner*—Howard N. Goldberg
*Assistant Examiner*—Joseph M. Gorski
*Attorney, Agent, or Firm*—Bacon & Thomas

[57] ABSTRACT

An impeller for use in a comminuting apparatus and defined by a base on which an even number of upwardly extending blades are supported, half of the blades sloping forwardly and half of the blades sloping rearwardly with respect to the axis of rotation, wherein the top and bottom ends of the blades are configured to collectively define an undulating path along which the product is caused to flow during rotation of the impeller.

4 Claims, 14 Drawing Figures

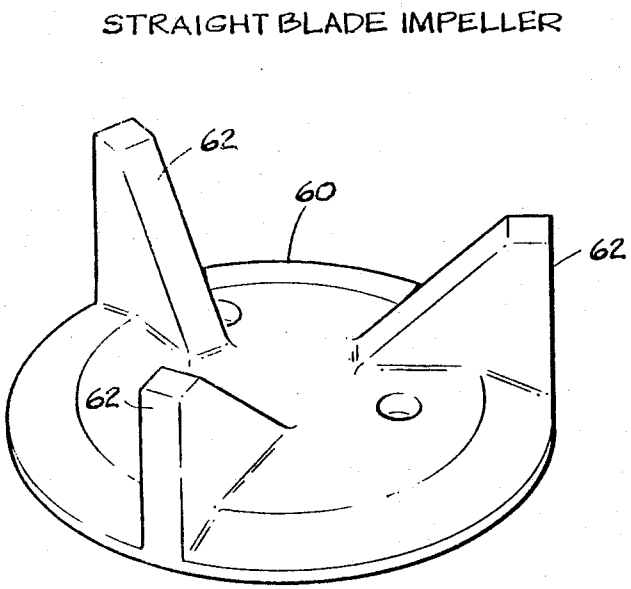
Fig. 1
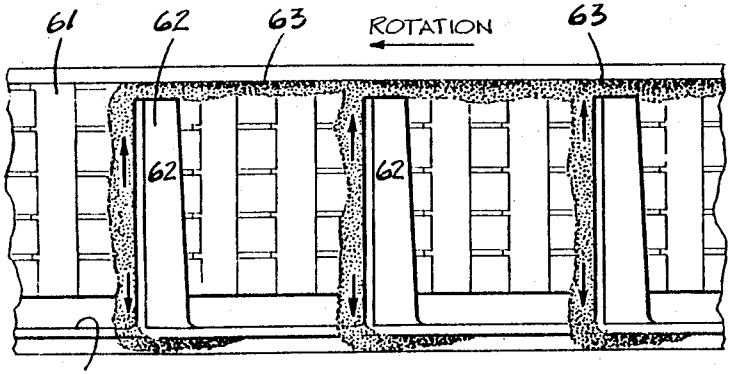
Fig. 2
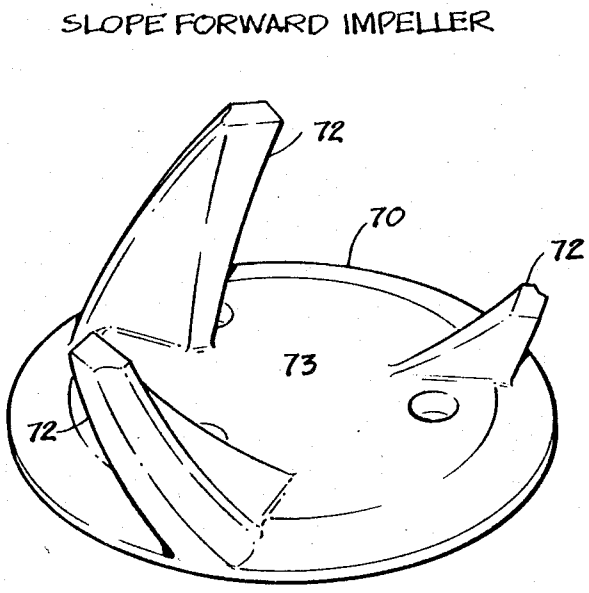
Fig. 3
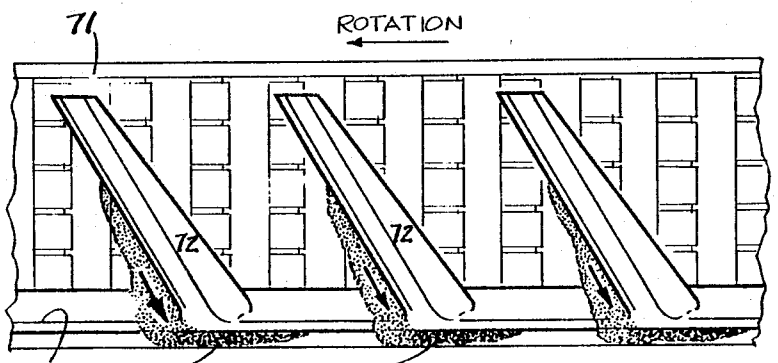
Fig. 4
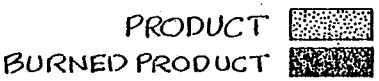

PRODUCT

BURNED PRODUCT

49'
.007"
47
14
5
24
34
33
38
36
35
27
32
2
29
28
31
15
16
50
7
32
6
30
26
25
12
13
19
48
24
29'
1
18
20
21
22
23
11
10

IMPELLER FOR COMMINUTING EQUIPMENT

This application is a continuation of application Ser. No. 733,536, filed 5-13-85, now abandoned, which is a division of application Ser. No. 546,182, filed 10-17-83, now U.S. Pat. No. 4,610,397.

BACKGROUND OF THE INVENTION

In order to promote a better understanding of the subject invention as alluded to in the Abstract it is deemed beneficial to present a background of information in order that the attributes or advantages of the improved impeller can be compared with prior impellers which have been and are being utilized in the food processing industry.

According to the inventors:

"The new impeller structure is not only a relatively low noise device, but its operation produces better results in size reducing a product than any impeller structure previously used. An important product used with the machine is meat and for this reason, meat will be referred to in describing the benefits of the new impeller. However, the new impeller is an improved device for the size reduction of many products such as, for example, horseradish, nuts, cheese, animal by products (used in pet foods), citrus peel, fresh corn (used for making canned or frozen cream style corn), field corn (for making corn mass for Mexican style foods), dehydrated potatoes (for producing potato flour) fish, rubber, coconut, sorghum, tomatoes, peppers, apricots, cranberries and pickles."

The following describes the problems experienced with various types of impellers: For use with most products to be size reduced, impeller speeds generally range between 3,600 and 6,500 RPM (revolutions per minute). The inside diameter of cutting heads or cylinders as presently used is six inches. With an impeller speed of 3,600 RPM, the centrifugal force is 1,106 gs. This means that a piece of meat rotating inside the cutting head at this speed is forced against the wall of the cutting head with a pressure of 1,105 times the weight of the piece of meat. Centrifugal force increases with the square of the speed and at 6,500 RPM, the centrifugal force is 3,602. This would make a piece of meat press against the wall of the cutting head with a pressure of 3,602 times the weight of the piece of meat.

FIG. 1 illustrates what may be referred to as a straight blade impeller 60 and FIG. 2 illustrates what happens to meat when being pushed or driven around inside a cutting head 61 by the straight blade impeller of FIG. 1. A combination of the centrifugal force and the force required to push the meat over the inside wall of the cutting head causes the meat to become semi-liquid so that is spreads out over the entire surface of the impeller blade. This results in pressure at both the upper and lower ends of the impeller blades 62. Some of the meat is forced between the upper ends of the moving impeller blades and a stationary retaining plate. This friction tends to heat, cook and burn the meat as indicted at 63. This same condition exists at the lower ends of the impeller blades when meat is forced between the moving surface of the outside diameter of the bottom plate and a stationary surface of the head. If small amounts of meat are fed to the machine, the meat is cut quickly and discharged quickly, and the condition of overheating the meat is not serious. The condition becomes serious when large amounts of meat are fed to the machine and this thereby limits the value of the equipment. The noise produced by the straight blade impeller is a serious matter to the extent that this type of impeller is seldom used.

FIG. 3 illustrates what may be referred to as a slope forward impeller 70 and is depicted in FIG. 5 of a Joe R. Urschel U.S. Pat. No. 3,823,880 which issued on July 16, 1974, and a FIG. 4 related to FIG. 3 depicting what happens to the meat in the impeller. The pressure required to force the meat around inside a cutting head 71 causes the meat to slide downward along the surface of the impeller blades 72 and press against the bottom plate or base 73 of the impeller. The pressure becomes so great that some of the meat is forced between the moving outside diameter of the bottom plate of the impeller and the stationary surface of the cutting head. This causes heating, cooking and burning of the meat as indicated at 74. This condition is not too serious when small amounts of meat are fed to the machine but becomes serious when attempting to use the full capacity of the machine.

FIG. 5 depicts what may be defined as a slope backward impeller 80 which is also illustrated in FIG. 7 of the Urschel U.S. Pat. No. 3,823,880 referred to in the preceding paragraph and FIG. 6 related to FIG. 5 shows blades having product engaging surfaces which slope or are inclined rearwardly. In this case, the meat is forced upward and over the top of the moving impeller blades 81. The friction between these and the stationary retaining plate relative to a cutter head 82 causes the meat to heat, cook and burn as indicated at 83. This impeller is useful when feeding small amounts of meat to the machine but can not be used when feeding meat at the full capacity of the machine.

FIG. 7 illustrates what we call a "dogleg" impeller 90, and FIG. 8 relates to FIG. 7, with notations depicting its operation. The "dogleg" impeller may be considered to be a combination of the structures of FIGS. 3 and 4 and FIGS. 4 and 5 alluded to above. More specifically, the lower half of each impeller blade 91 is a slope backward impeller blade, and the upper half of each impeller blade is a slope forward impeller blade. This could also be called "V" type impeller. This is the impeller type that consumes most of the manufacturing effort today. Up to this time, it has proven to be the best impeller type. It has a low noise output and from this standpoint is acceptable by all users. The meat is maintained at the middle of each impeller blade as indicated at 92 so that there is no danger of heating, cooking and burning of the meat at the ends of the blades. There are, however, two serious disadvantages to using this impeller. The machine produces a better cut product if the meat can be distributed over the full length of the blade rather than to be bunched up in the middle of the blade. A more serious problem is that there is great wear half way up the cutting head with little or no wear at other parts of the head. There would be much more utilization of the cutting head if the full length of the head could be used.

The objectives of the invention, detailed illustrations of the impeller structure and its operative relationship to a cutting head or cylinder and claims will appear subsequently, suffice to state in a preliminary way in comparative relation to the foregoing impellers briefly described above that the new or improved impeller has proven to have outstanding advantages over any other type of impeller. The advantages of this impeller is that the noise produced is within acceptable limits, there is no opportunity for meat to press against stationary parts to heat and burn, and the entire length of the blades are used to distribute the meat evenly over the inside surface of the cutting head. This impeller is composed of four blades. It can be made with any even number of blades. Each alternate blade is sloped backward and the other blades are sloped forward. The sloped backward blades are shortened at the top end and the sloped forward blades are shortened at the bottom ends. When meat is being cut by a sloped backward blade, the meat will gradually slide upward until it reaches the end of the blade. Then the meat will slide over the top of the blade and be picked up by the top of a sloped forward blade. The meat will slide gradually downward until it reaches the end of this blade. Then the meat will slide under the bottom of the blade and be picked up by the sloped backward blade. This procedure will continue until the piece of meat has all been cut and discharged from the machine. When the idea of this impeller was conceived, it was believed that meat would follow this path. High speed moving pictures were made of the machine cutting meat. The pictures were taken at about 8,000 pictures per second and then projected at about 15 pictures per second. The theory was confirmed with the result of these pictures.:

In addition, attention is directed for reference purposes to a Joe R. Urschel U.S. Pat. No. 3,196,916 which issued on July 27, 1985, and one U.S. Pat. No. 3,255,646 which issued on June 14, 1966, both being directed to segmented cutting heads and another U.S. Pat. No. 3,989,196 which issued on Nov. 2, 1976 involving a one-piece cutting head or cylinder. These additional Patents, among other other things, serve to show the operative relationships between tubular cylindrical cutting heads and impeller structures for comminuting or reducing the size of various products or materials and copies of all Patents referred to in this application are attached and made a part of the record.

OBJECTIVE OF THE INVENTION

In view of the above preliminary information it should be manifest that an important object of the subject invention is to provide an impeller structure embodying new principles of design and construction whereby the product to be comminuted is distributed uniformly or evenly to the cutting edges of a cutter head. More particularly, the impeller structure is adapted for rotation in a tubular cylinder cutter head having transverse passages and circumferentially spaced cutting edges adjacent to the passages whereby blades of the impeller are disposed in a complementary circumferentially spaced relationship and so constructed that the blades will successively receive the product in a manner to cause an undulation of its flow from one blade to the other for substantially uniform or even presentation to the cutting edges throughout the length of the cutter head and thereby cause the product to be comminuted for flow outwardly through the passages in particles or pieces of substantially uniform size.

A significant objective is to provide an impeller structure having an annular base provided with a plurality of blades which are of the same length, and which are alternately displaced upwardly and downwardly with the upwardly displaced blades having forwardly inclined product engaging surfaces and the downwardly displaced blades having rearwardly inclined product engaging surfaces.

A particularly important object of the invention is to provide an impeller structure for use in a cutter head in which the outer lower-most portions of the rearwardly inclined blades respectively extend radially outward from the periphery of the base of the impeller and the lowermost outer portions of the forwardly inclined blades in combination with the periphery of the base, an annular support on which the cutter head is mounted and the latter define what may be termed passage-ways, or openings through which at least some of the product may be caused to flow onto the surfaces of the rearwardly inclined blades. Otherwise expressed, the blades are so designed and constructed that the product to be reduced in size will be caused to flow in a serpentine path successively from one blade to another to substantially uniformly or evenly present the product to the cutting edges of the cutter head for comminution and exit outwardly through the passages in the cutter head.

A specific but important objective is to provide an impeller structure or equipment which is operable well within the Health Standards establihed by Federal and State Statutes.

Another object is to provide an impeller structure which offers an improved method of directing or dispersing a product uniformly against cutting edges in a cutter head.

A very important object of the invention is to provide an impeller structure embodying improved structural attributes whereby when utilized with a cutter head, the factor of friction produced by the product travelling forcibly against internal surfaces of the cutter head and surfaces of the impeller is appreciably minimized or reduced thereby substantially preventing any heating, cooking or burning of the product in order to obtain a superior resultant comminuted product.

A further object is to provide an impeller structure having any appropriate number of pairs of blades and in which the blades are alternately sloped forwardly and rearwardly whereby to materially reduce the noise level of comminuting a product.

Additional objects and advantages of the invention will become apparent after the description hereinafter set forth is considered in conjunction with the drawings annexed hereto.

DRAWINGS

FIGS. 1 through 8, as alluded to above, illustrate various forms of prior art impeller structures in order to promote a better foundation for the disclosure of the subject invention illustrated in FIGS. 9 through 14;

More specifically FIGS. 1 and 2 are directed to what may be referred to as a straight blade impeller and FIG. 2 shows the flow of a product in a cutter head;

FIGS. 3 and 4 are directed to a slope forward impeller and FIG. 4 shows the flow of a product in a cutter head;

DESCRIPTION OF FIGS. 9–13

As alluded to above in the Background of the Invention, FIGS. 1 through 8 have been presented to show the status of certain prior art in order that the equipment and/or impeller structure embodying the subject invention or inventions as disclosed in FIGS. 9 through 14 can be more readily understood and appreciated and compared with the prior art.

Figure 7:
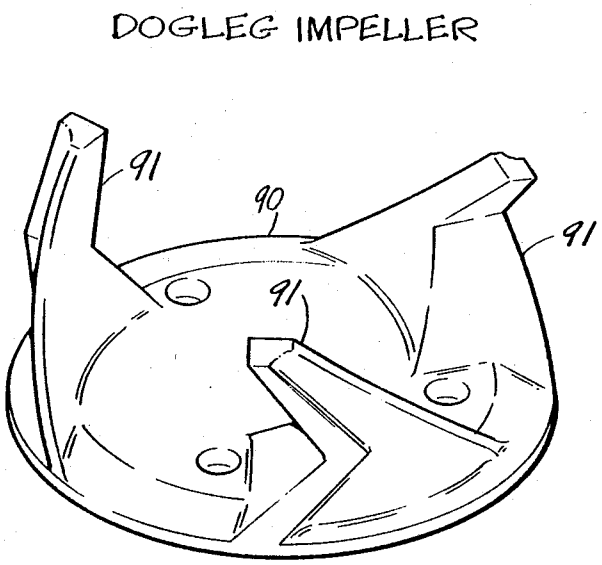
FIGS. 7 and 8 depict an impeller having "dogleg" blades and FIG. 8 shows the flow of a product in a cutter head.
Figure 8:
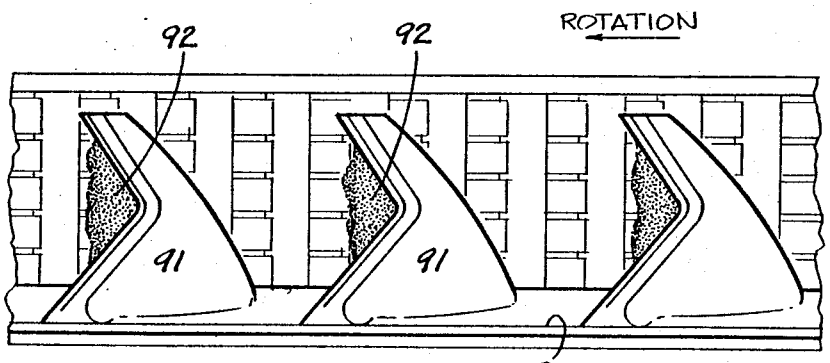
Figure 5:
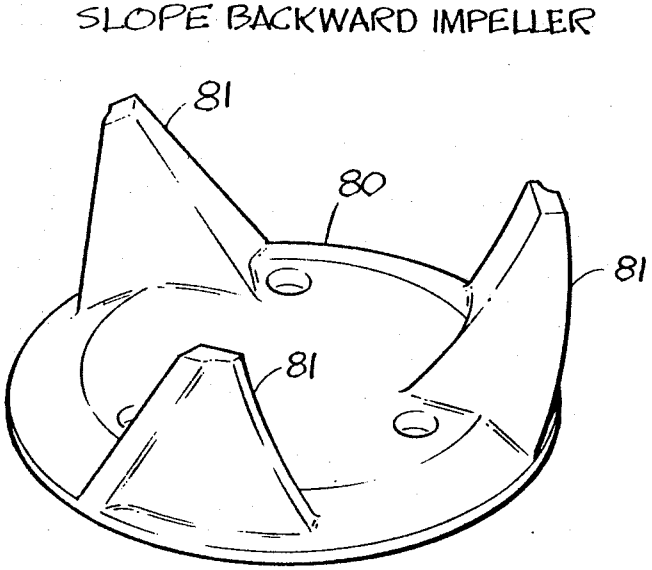
FIGS. 5 and 6 illustrate an impeller having impact surfaces which slope rearwardly and FIG. 6 shows the flow of a product ina cutter head.
Figure 6:
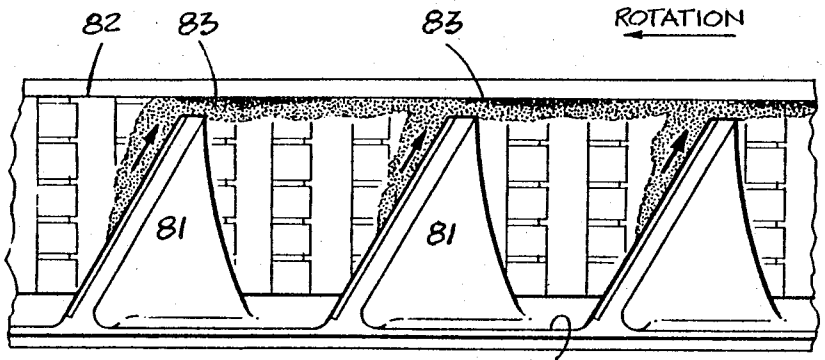
Figure 9:
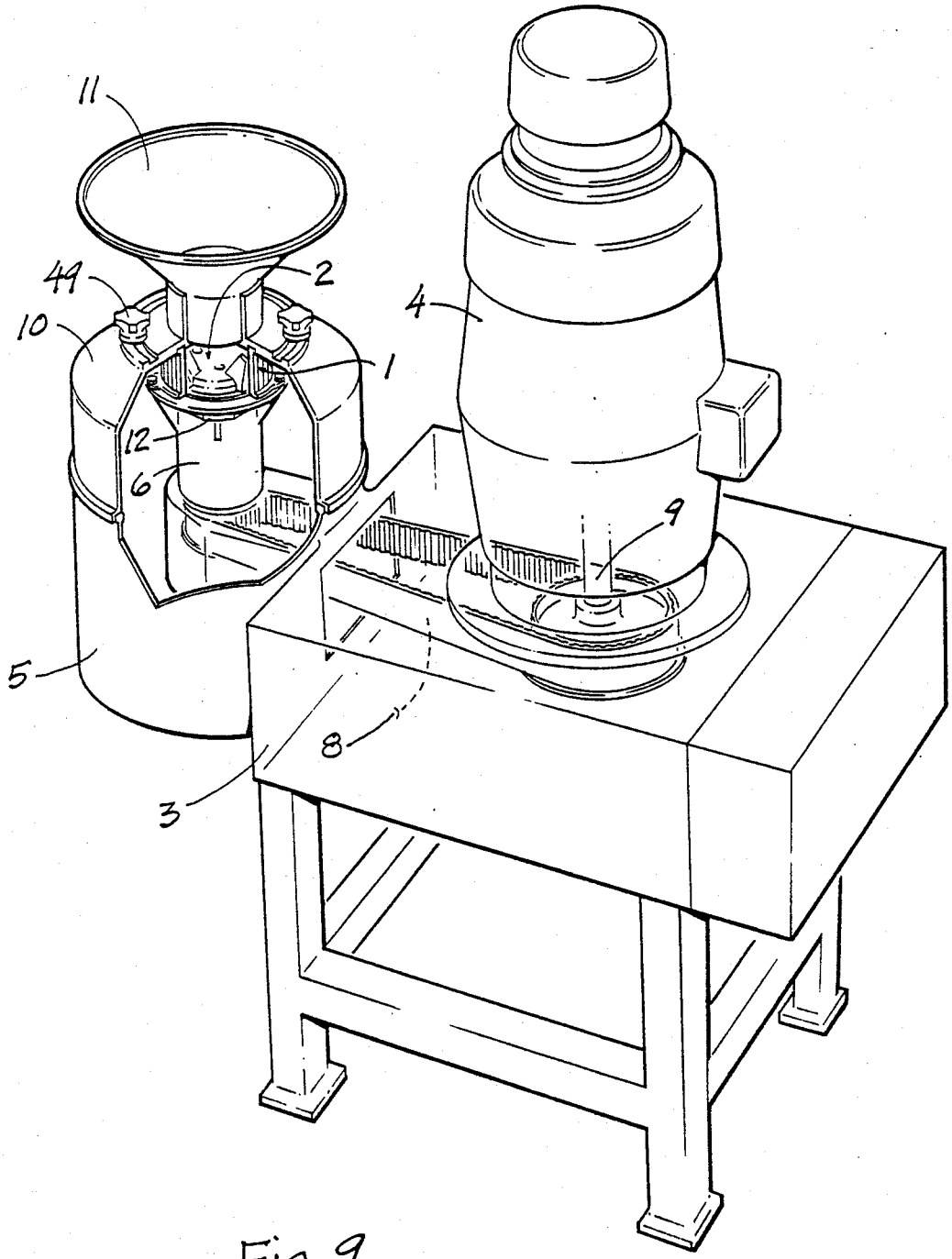
FIG. 9 is a perspective view of the equipment or machine, with a portion broken away, to illustrate the operative relationship of a cutter head and the impeller structure, embodying the invention.
Figure 10:
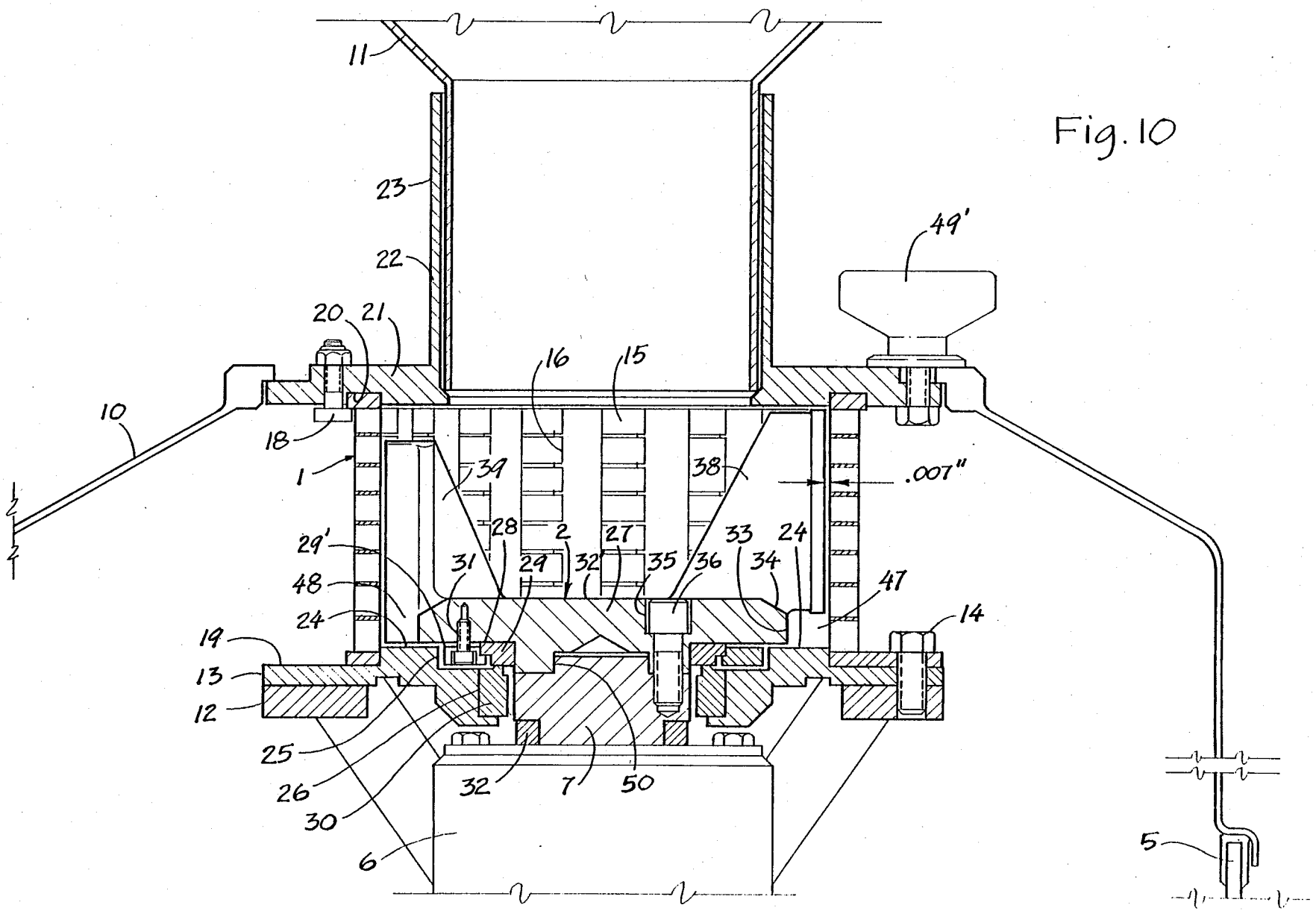
FIG. 10 is an enlarged partial pictorial view of the cutter head and the impeller structure, depicted in FIG. 9, with portions of the equipment broken away.
Figure 13:
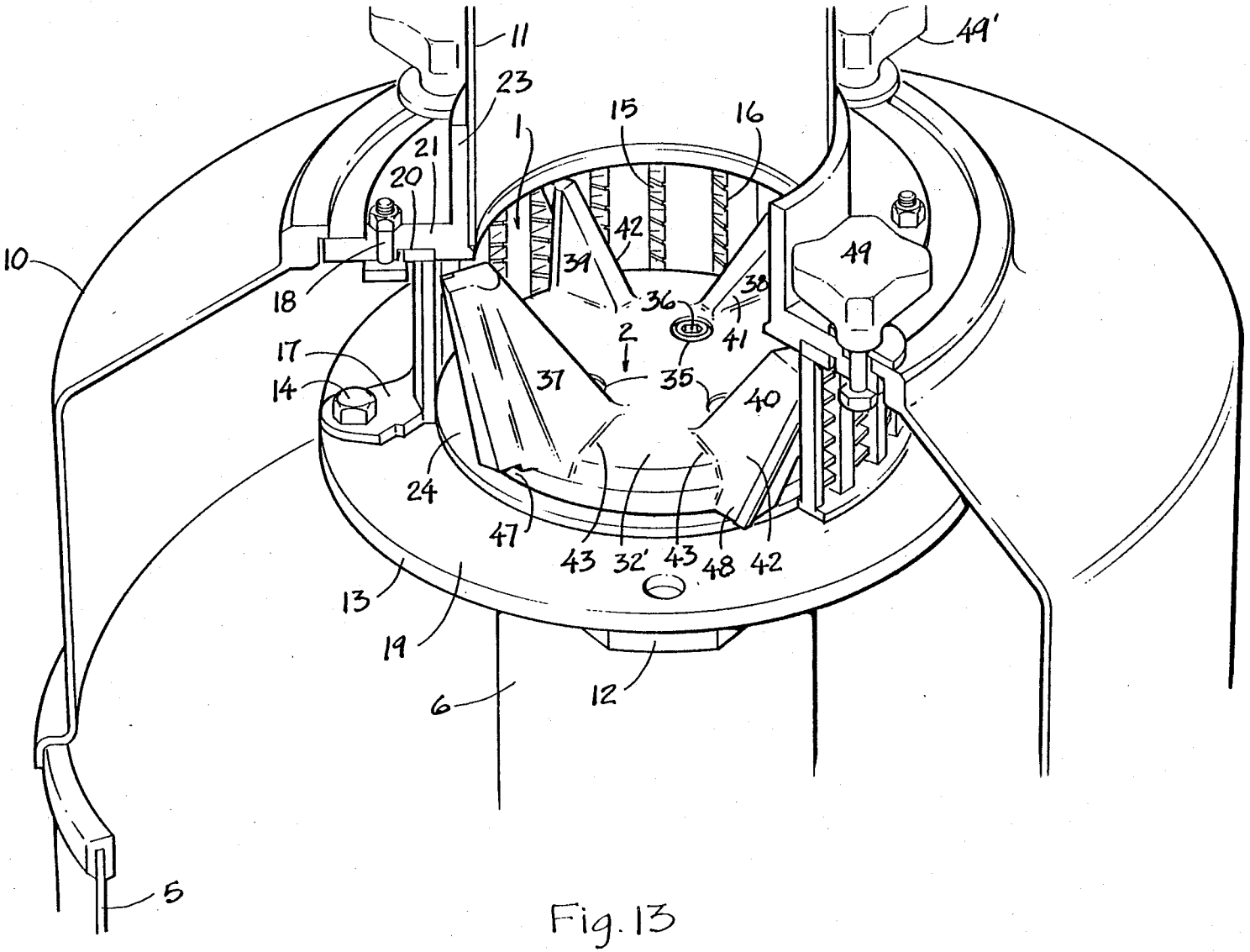
FIG. 13 is a vertical section taken through the machine.

More particularly, and as illustrated in FIGS. 9, 10 and 13, the equipment or machine utilizes a cutter head generally designated 1 and an improved impeller structure generally designated 2. The equipment may comprise a table 3 which supports an upstanding electric motor unit 4 and a lower cylindrical section 5 of a housing at one end of the table and a stationary bearing structure or spindle 6 within which a driven shaft, provided with a fitting 7, is rotated by a belt 8 connected to a drive shaft 9 depending from the motor 4 in a conventional manner. Controls, not shown, are provided for operating the machine and regulating the speed of the impeller 2 in the cutter head 1. A cover section 10 of the housing is connectible to it slower section 5 and carries a funnel hopper 11 whereby to assist in introducing a product into the cutter head. The outflow of the comminuted product through the passages in the cutter head is controlled for downward flow by the housing for deposit in a receptacle, not shown, below the housing for eventual use.

Figure 12:
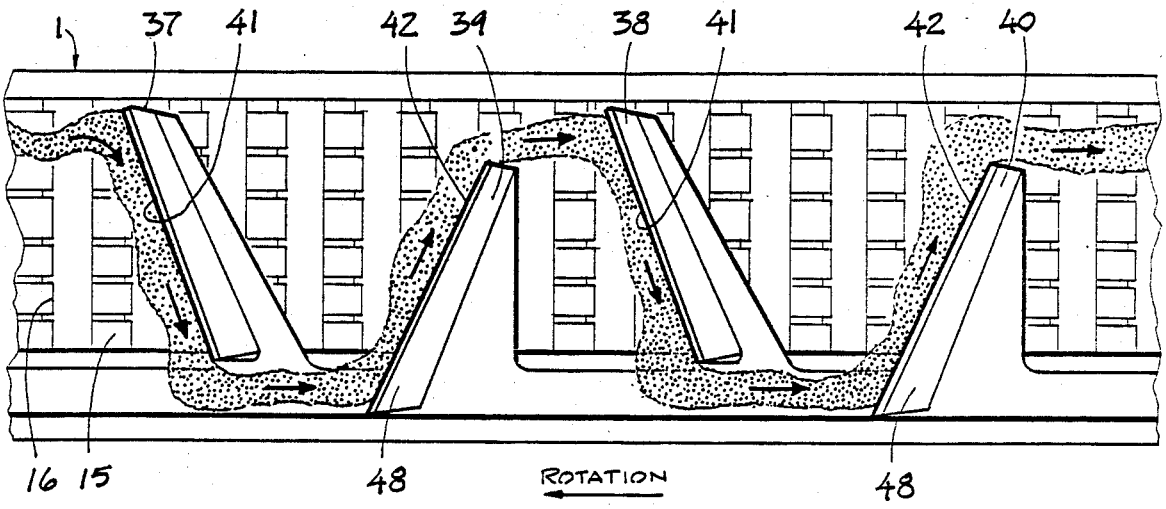
FIG. 12 is a diagramatic view illustrating the undulating flow of the product produced by the impeller in a cutter head.

As best depicted in FIGS. 10, 12 and 13, the spindle or post 6 is provided with a stationary upper annular mounting 12 and an annular support 13 is detachably connected to the mounting by screws 14 (one shown) and the cutter head 1 is fixed on the support. The cutter head maybe constructed in various ways but is preferably constructed in one-piece and provided with circumferentially spaced transverse passages 15 and adjacent circumferentially spaced cutting edges 16, which cut, reduce the size of, or comminute the product when it is directed against the cutting edges by the impeller 2 for flow outwardly through the passages for downward discharge through the housing. The cutter head is also provided with apertured side lugs 17 through which screws 14 are extended for fixedly connecting a lower end of the head in an annular recess 19 provided in the support 13. An upper end or ring of the head is disposed in an annular recess 20 provided in the underside of a radial flange 21 of a fitting or transition piece 22 having an upstanding tubular portion 23 which detachably supports the funnel hopper 11 above referred to. The ring or upper end of the cutter head is held in the recess 20 by bolts 18, (one shown) which extend through the flange 21 of the fitting 22 and the upper section 10 of the housing is attached to the fitting by bolts 49'.

It should be noted that the support 13 is provided with an upper annular planar surface 24 and a pair of adjacent inner annular recesses 25 and 26; that an annular base 27 of the impeller is provided with a bottom annular recess 28; and that a pair of engaged annular seals 29 and 30 are respectively disposted in the recesses 28 and 26 of the base and support whereby to exclude the flow of any product outwardly from between these components. The seal 29 is preferably detachably held in the recess 28 by a ring 29' and a plurality of screws 31 (one shown), the heads of which are disposed in the ring and their shanks are threadably connected to the base 27. It should be noted that the fitting 7 is interlocked with the base 27 since an upper portion thereof is received in a bottom central recess 50 in the base and that the fitting may also find at least partial support on a bearing 32 surrounding the fitting 7 of the driven shaft.

Referring to FIGS. 10, 11, 12 and 13 which clearly depict the structural characteristics of the impeller structure 2, the latter, among other things, comprises the annular base 27 which has an upper planar surface 32' and a periphery 33, the latter of which is chamfered at 34. The central area of the base is preferably provided with three circumferentially spaced apertures 35 through which screws 36 are extended into the fitting 7 for detachably connecting the impeller thereto. The impeller is also preferably provided with a plurality of four circumferentially spaced blades 37, 38, 39 and 40. These blades are alternately arranged so that the blades 37 and 38 constitute a pair which are diametrically disposed so that their upper ends extend upwardly above the planar surface 32' of the base 27 at a somewhat higher elevation than the pair 39 and 40 and may be referred to as forwardly inclined blades and the blades 39 and 40 constitute a pair which are diametrically disposed and have upper ends which extend upwardly a shorter distance from the surface 32' and may be referred to as rearwardly inclined blades. The pair of forwardly inclined blades 37 and 38 are respectively provided with product engaging surfaces 41 and the pair of rearwardly inclined blades 39 and 40 and are respectively provided with product engaging surfaces 42. It should be noted that the product engaging surfaces 41 and 42 are of an all inclusive character so that the cutting of the product is substantially accomplished by the surface 41 and 42 which force the product against the cutting edges of the cutter head 1. The impeller is preferably rotated in a clockwise direction as indicated by the arrow in FIG. 11. It should also be noted that the impeller is preferably of a one-piece structure; that the blades are generally triangular in cross-secion throughout at least a portion of their length; that their junction areas with the base 27 are curved as indicated at 43 in order to promote sanitation; and that outer longitudinal corner areas of the blades are preferably respectively rabbeted at 44 in which strips or inserts 45 of hardened material are fixedly secured so that their outer sharp edges 46 are preferably adjusted to a running tolerance of 0.007" with the cutting edges 16 of the cutter head, as indicated in FIG. 10, and serve to prolong the life of the blades and promote accuracy in presenting the product to the cutting edges.

Figure 11:
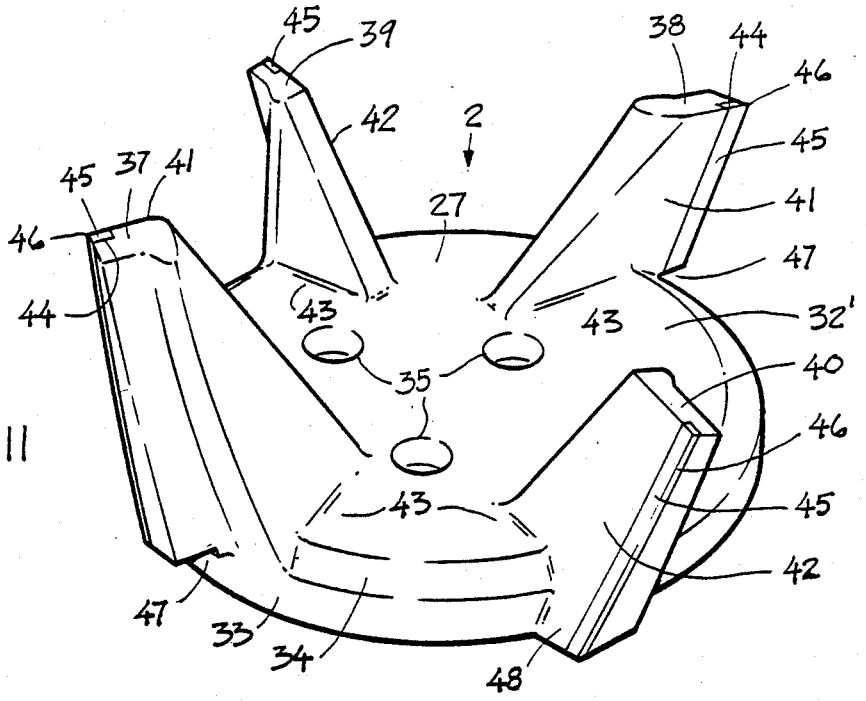
FIG. 11 is a pictorial view of the impeller structure.

Attention is directed to FIGS. 10, 11 and 13 which also shows that outer lower portions of the blades 37 and 38, periphery 33 of the base 27 of the impeller, upper surface 24 of the support 13 and a lower inner cylindrical area of the cutter head define what may be termed passage-ways or openings 47 through which the product may flow or travel when the impeller is rotated in the cutter head. It should be observed that each of the pair of blades 39 and 40 has a lower integral portion 48 which extends radially outward from the periphery 33 of the base 27 of the impeller and that these portions assist in promoting the undulatory flow of the product in the cutter head to the cutting edges 16. As clearly illustrated by the shaded areas in FIG. 12. the product will flow or travel in an undulating or serpentine pattern or path. More specifically in this respect the forwardly inclined engaging surfaces 41 of the blades 37 and 38 and the rearwardly inclined engaging surfaces 42 of the blades 39 and 40 will be engaged by the product in an alternating fashion or mode. Otherwise expressed, the product will engage a forwardly inclined surface 41 of a blade 37 and then a rear inclined surface 42 of an adjacent blade 39 through an opening 47 and up the surface 42 and over an upper extremity of this blade where the product is picked up by the surface 41 of an adjacent blade 38 and so on. It should be observed that the shaded flow pattern of the product is uniform which is to indicate that the original texture of the product is substantially maintained during its presentation to the cutting edges of the cutter head, as distinguished from the contrasting shaded flow patterns depicted, for example, in FIGS. 2 and 6.

DESCRIPTION OF FIG. 14

Figure 14:
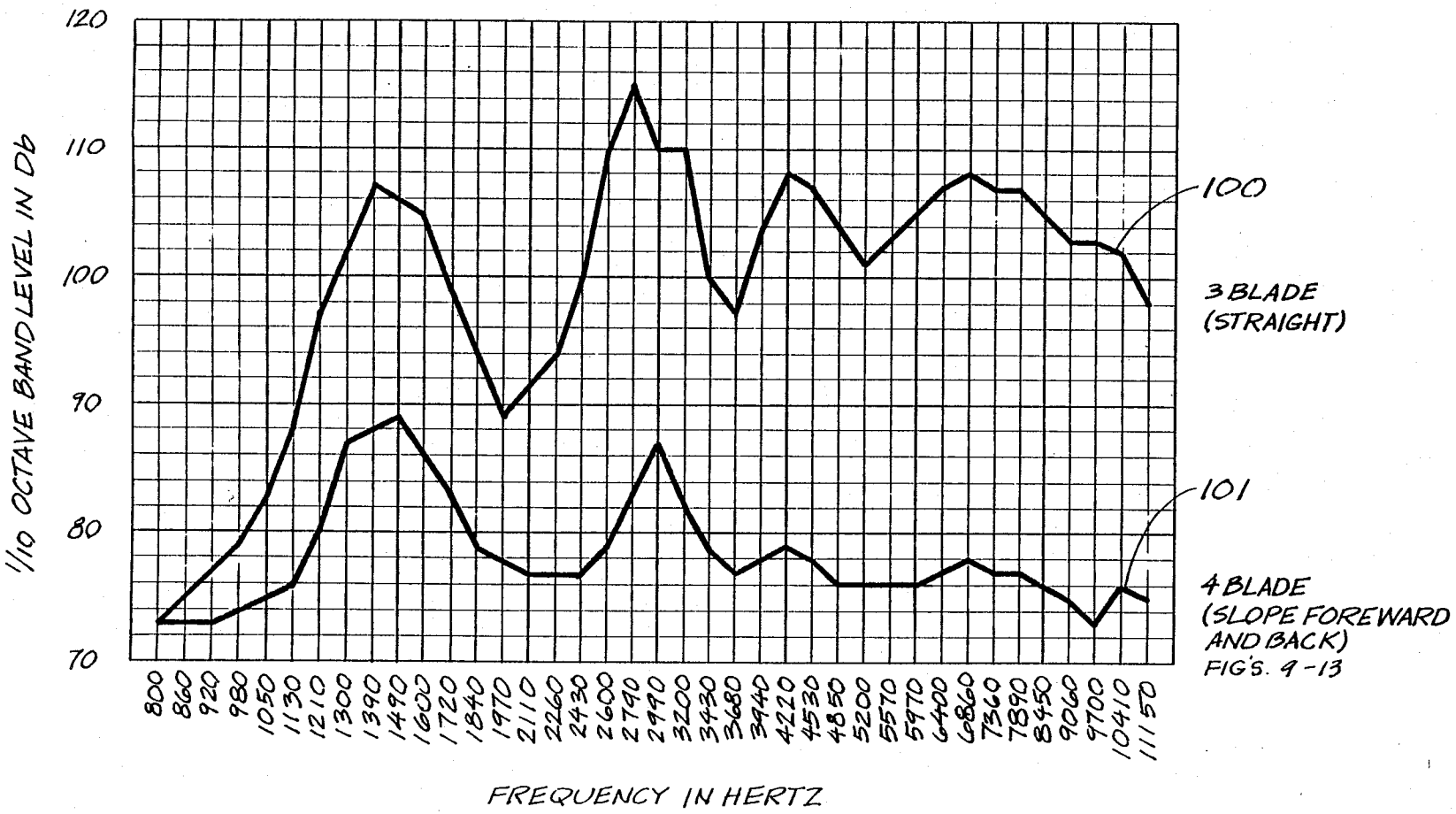
FIG. 14 is a graph or chart exemplifying technical attributes of the invention as compared to results obtained by certain conventional structures.

Referring now to FIG. 14 of the drawing there is disclosed a chart of comparative decibel rating of comminuting equipment and as a prelude to a brief description of these ratings it is considered appropriate to present the fact that the Occupation Safety and Health Act of 1970 of the United States has established a rule that a piece of machinery or equipment operating in the vicinity of an operator or person shall have a noise level no greater than 90 decibels. With this factor in mind, an important object of the subject invention, as alluded to above, is to provide a machine in which the sound of its operation is materially reduced to a level which is not destructive to the human ear.

In the cutting mill embodying the subject invention, the impeller when revolving in a cutting head cuts the air and it produces pressure pulses at a definite frequency depending on the number of vertical posts or circumferentially spaced portions providing knives or cutting edges, the number of blades provided on the impeller, and the speed of the impeller. For example, one form of a conventional impeller with three blades operating in a cutting head having 24 knives or cutting edges and with the impeller operating at 3600 RPM, the frequency produced will be $3\times24\times3{,}600=259{,}200$ cycles per minute of 4,320 Hertz. Most damage to the human ear is caused by frequency in the general range of 1,000 to 5,000 Hertz, and the aforesaid frequency of 4,320 Hertz is obviously within this range.

With the foregoing in mind, it was determined that if the frequency could be increased, both the point of normal human hearing which ends up at 15,000 Hertz and the sound produced by the machine or mill would not be objectionable. With this objective in mind, provision has been made in the machine and particularly the improved impeller structure whereby to appreciably reduce the noise level.

In view of FIG. 14 its hould be manifest that a machine utilizing a three bladed impeller has a relatively high range of noise as indicated at 100 and that the impeller 2 of the subject invention as indicated at 101 in the chart has a noise rating appreciably lower than the one indicated at 100 and therefore there is ample evidence to support those claims which refer to noise level.

SUMMARY

In summarizing the attributes of the new impeller structures as described above, the Inventors submit that it has at least three advantages over previous impeller structures which are listed as follows:

"(1) The new impeller structures produce a low volume of sound. Manufacturers who use size reduction equipment will not permit equipment of the general character disclosed in the Patents above referred to, to be used in their operations with parts that produce a high volume of sound.

(2) The new impeller structures cause the machine to cut the product freely without having the product rub against stationary surfaces. When the moving product rubs against stationary surfaces, it heats and burns the product which is not acceptable to users of the equipment.

(3) The new impeller structures cause the product to be spread evenly over the inside cutting surface of the cutter head. If cutting is permitted at only a small portion of the cutter head, then through-put of the machine is reduced and excessive wear and dulling of the cutting edges is produced at only a small portion of the cutting area."

Having thus described our invention or inventions, it is obvious that various modifications or additions to those described may be made in the same without departing from the spirit of the invention and, therefore, we do not wish to be understood as limiting ourselves to the exact forms, constructions, arrangements, and combinations of the components herein shown and described.

We claim:

1. An impeller for comminuting a product in an apparatus defined by a bottom support and having an interior wall provided with a plurality of transverse passages and a plurality of corresponding cutting edges disposed adjacent the passages, which impeller comprises:

(a) an annular-shaped base having a periphery and an upper planar surface;

(b) an even number of blades, each blade including a top end and a bottom end, the botton end of each blade being supported on the periphery of the base and extending inwardly partially across the upper planar surface so as to position a majority of each blade in an upwardly extending disposition, with the top end of each blade being positioned above the upper planar surface of the base;

(c) half of the total number of blades sloping forwardly from the base towards the direction of rotation and the remaining half of the total number of blades sloping rearwardly from the base away from the direction of rotation with respect to an impeller axis of rotation, each forwardly sloping blade being positioned between two rearwardly sloping blades;

(d) the top end of each forwardly sloping blade extending beyond the top end of each rearwardly sloping blade, and the bottom end of each rearwardly sloping blade extending beyond the bottom end of each forwardly sloping blade;

(e) each blade including a product engaging surface facing towards the direction of rotation; and (f) the product engaging surfaces, to ends and bottom ends of the blades being configured to define an undulating path along which a product is caused to flow during rotation of the impeller, which path continues from the top end and down the product engaging surface and around the bottom end of each forwardly sloping blade, and up the product engaging surface and around the top end of each rearwardly sloping blade.

2. The impeller of claim 2 wherein each blade is generally triangular in cross section throughout at least a portion of its length.

3. The impeller of claim 2 wherein the periphery of the base is chamfered.

4. The impeller of claim 2 wherein the configuration of the impeller reduces noise level and friction when the impeller is rotated at a high rate of speed during comminution of the product.

* * * * *